US010428617B2

(12) United States Patent
Radtke et al.

(10) Patent No.: US 10,428,617 B2
(45) Date of Patent: Oct. 1, 2019

(54) PACKER

(71) Applicant: MorphPackers Limited, Aberdeen (GB)

(72) Inventors: Cameron Hill Radtke, Aberdeen (GB); William Luke McElligott, Aberdeen (GB); Davidson Harman, Aberdeen (GB)

(73) Assignee: MORPHPACKERS LIMITED, Aberdeen (GB)

( * ) Notice: Subject to any disclaimer, the term of this patent is extended or adjusted under 35 U.S.C. 154(b) by 128 days.

(21) Appl. No.: 15/671,210

(22) Filed: Aug. 8, 2017

(65) Prior Publication Data

US 2018/0045016 A1 Feb. 15, 2018

(30) Foreign Application Priority Data

Aug. 9, 2016 (GB) ..... 1613684.8

(51) Int. Cl.
*E21B 33/129* (2006.01)
*E21B 33/12* (2006.01)
(Continued)

(52) U.S. Cl.
CPC ..... *E21B 33/1292* (2013.01); *E21B 23/01* (2013.01); *E21B 33/1208* (2013.01); *E21B 33/1285* (2013.01); *E21B 43/103* (2013.01)

(58) Field of Classification Search
CPC .. E21B 43/103; E21B 43/105; E21B 33/1208; E21B 33/1293; E21B 23/01; E21B 33/1295
See application file for complete search history.

(56) References Cited

U.S. PATENT DOCUMENTS 3,155,164 A * 11/1964 Keener ..... E21B 23/065 166/134
3,391,740 A 7/1968 Edwards
(Continued)

FOREIGN PATENT DOCUMENTS

EP 2952672 A1 12/2015
GB 2512506 B 7/2015
(Continued)

OTHER PUBLICATIONS

Intellectual Property Office of the UK Patent Office; Search Report for GB1613684,8; entire document; dated Nov. 29, 2016; UK Patent Office, United Kingdom.
(Continued)

*Primary Examiner* — Kipp C Wallace
(74) *Attorney, Agent, or Firm* — Law Office of Jesse D. Lambert, LLC

(57) ABSTRACT

A morphable packer and method of setting the packer to anchor one tubular within another tubular or borehole, and create a seal across an annulus in a well bore. The packer is formed as a single tubular member having a central section between end sections. Undulations are formed on the tubular member to create recesses in which annular slips having oppositely arranged inclined surfaces and an outer gripping surface are located to provide an anchoring arrangement. When morphed the slips move uniformly radially outwards and anchor to an outer tubular. Embodiments include pairs of reversed slips located in the recess, pairs of anchoring arrangements located along the tubular member and a gasket seal arranged around the tubular member.

17 Claims, 3 Drawing Sheets

(51) Int. Cl.

| | |
|---|---|
| ***E21B 33/128*** | (2006.01) |
| ***E21B 23/01*** | (2006.01) |
| ***E21B 43/10*** | (2006.01) |

(56) References Cited

U.S. PATENT DOCUMENTS

| | | | | |
|---|---|---|---|---|
| 3,659,647 | A | 5/1972 | Brown | |
| 5,000,265 | A | 3/1991 | Pleasants et al. | |
| 5,146,994 | A | 9/1992 | Pleasants et al. | |
| 5,542,473 | A | 8/1996 | Pringle et al. | |
| 6,123,148 | A | 9/2000 | Oneal | |
| 6,854,521 | B2 * | 2/2005 | Echols | E21B 33/12 166/120 |
| 6,920,927 | B2 | 7/2005 | Hirth | |
| 9,228,404 | B1 | 1/2016 | Jackson et al. | |
| 9,228,411 | B2 | 1/2016 | Themig | |
| 10,119,357 | B2 * | 11/2018 | Roselier | E21B 33/1216 |
| 10,125,567 | B2 * | 11/2018 | Martin | E21B 33/1212 |
| 2004/0069485 | A1 * | 4/2004 | Ringgengberg | E21B 33/128 166/187 |
| 2007/0039161 | A1 * | 2/2007 | Garcia | E21B 43/103 29/507 |
| 2007/0169944 | A1 * | 7/2007 | Parker | E21B 43/103 166/380 |
| 2009/0056956 | A1 | 3/2009 | Ingram | |
| 2012/0199339 | A1 * | 8/2012 | Hallundbæk | E21B 33/127 166/134 |
| 2013/0192853 | A1 * | 8/2013 | Themig | E21B 33/1216 166/387 |
| 2014/0145402 | A1 * | 5/2014 | Hallundbæk | E21B 33/12 277/334 |
| 2015/0337619 | A1 | 11/2015 | Hern et al. | |
| 2015/0345249 | A1 * | 12/2015 | Gorrara | E21B 33/127 166/387 |

FOREIGN PATENT DOCUMENTS

| | | |
|---|---|---|
| WO | WO 2007/021975 A1 | 2/2007 |
| WO | WO 2016/055775 A1 | 4/2016 |

OTHER PUBLICATIONS

European Patent Office as Int'l Search Authority; Int'l Search Report for PCT/GB2017/052325; entire document; dated Dec. 20, 2017; European Patent Office, The Netherlands.

* cited by examiner

PACKER

The present invention relates to an apparatus and method for anchoring a tubular within another tubular or borehole, and creating a seal across an annulus in a well bore. In particular, though not exclusively, the invention relates to a morphable packer which includes reversed slips.

Packers are well known in the exploration and production of oil and gas wells and used to form a seal between tubular members, such as a liner, mandrel, production tubing and casing or between a tubular member, typically casing, and the wall of an open borehole. The seal prevents fluid flow in the annulus and can therefore be used to isolate portions of the annulus and allow access to distinct sections of the formation. Packers may also anchor an inner tubular to an outer tubular or borehole wall.

Traditional packers incorporate an elastomeric seal which is compressed to bridge the annulus and contact the outer tubular/borehole wall. Additionally toothed grips, in the form of slips, can be made to engage the outer tubular/borehole wall by forcing a wedge under the slip. A disadvantage of these arrangements is that a flow path can exist between the seal, the anchoring mechanism and the body of the mandrel on which the component parts are mounted. This flow path is a leak path across the seal of the packer which limits the use of the packer.

WO2016/055775 describes a packer in which no leak path can exist as the mandrel body itself is expanded to create the seal between inner tubular i.e. the mandrel and the outer tubular of borehole wall. This morphable packer is illustrated in FIG. 1. Morphable packer A is a tubular member B having a throughbore C with a central portion D having a greater diameter than each end portion E with tapered portions F there between. Gripping elements G are arranged on the tapered portions F. Morphing of the tubular member B by fluid pressure against the inner surface H of the tubular member D, causes the central portion D to expand and create a seal between the central portion and an outer cylindrical structure, such as a wellbore or casing. At the same time, the gripping elements G are moved radially outwards to engage with the cylindrical structure. The gripping elements G act as slips which are activated by morphing the tubular member B. End pieces 3 in the form of sleeves, cover the tubular member B behind each gripping element G to limit expansion to only the central D and tapered F portions. In this way, the seal and slips are activated without risk of creating a leak path through the packer A between the end portions.

While this arrangement has the advantage of creating an anchored seal without the possibility of a leak path, it does have a number of disadvantages. As the slips are arranged on a tapered surface, they will naturally want to slide away from the central portion when expansion of the tapered surface occurs, in the same way as a wedge driven under the prior art slips. To prevent this, the end pieces must abut the slips so the slips are forced radially outwards on morphing. However, as the end pieces are created in a material with low yield to resist morphing, the tapered portions are fixed at their outer edges and thus morphing across the taper is not uniform and is less effective towards the end pieces. Consequently, the gripping surface of each slip is not moved uniformly outwards which affects successful anchoring of the morphable packer.

It is therefore an object of at least one embodiment of the present invention to provide a morphable packer with an improved anchoring arrangement.

It is a further object of at least one embodiment of the present invention to provide a method for setting a morphable packer.

According to a first aspect of the present invention there is provided a morphable packer comprising:

a tubular member having a throughbore, the tubular member arranged to be run in and secured within a larger diameter generally cylindrical structure;

the tubular member having first and second end sections with a central section therebetween;

the central section including an anchoring arrangement, the anchoring arrangement comprising: a recess located circumferentially around an outer surface of the central section, the recess having opposing side walls which are each tapered from a bottom of the recess to the outer surface; and at least one gripping element having an outward facing surface adapted to grip and an inclined edge; wherein the at least one gripping element is initially located within the recess and the inclined edge abuts one of the side walls of the recess; and upon morphing of the tubular member a seal is created between the central section and the cylindrical structure, and the at least one gripping element is moved radially outwards by the morphing action on the tubular to engage with the cylindrical structure.

In this way, the gripping element is arranged in the central section away from the ends so that radially outward movement of the gripping element is not compromised during morphing as in the prior art.

In a first embodiment, the gripping element is substantially triangular in cross-section, comprising the outward facing surface and two inclined edges with each inclined edge arranged to abut each side wall of the recess. In this way, the morphing pressure acts on the recess to force the gripping element radially outwards. In this way, the gripping element does not move longitudinally only radially, being perpendicular to the longitudinal axis.

In a second embodiment, the gripping element is substantially triangular in cross-section, comprising the outward facing surface, the inclined edge and an adjoining surface with there being two gripping elements within a recess and the adjoining surfaces contact each other. In this way, morphing pressure acting on the inclined side walls, will force the gripping elements together at the adjoining surfaces as they are also pushed radially outwards.

Preferably, the gripping element comprises one or more sections, the one or more sections being arranged circumferentially around the expandable portion and having an outer surface including at least a portion adapted to grip. Advantageously, the gripping element comprises one section being a substantially annular member. The outward facing surface may comprise a plurality of circumferential ridges, the ridges providing a spike or tooth tip for gripping the inner surface of the existing casing. Other gripping arrangements, as are known in the art, may be applied to the surface of the gripper element. In this way, for the second embodiment, the known wedge shaped slips can be used.

The large diameter structure may be an open hole borehole, a borehole lined with a casing or liner string which may be cemented in place downhole, or may be a pipeline within which another smaller diameter tubular section requires to be secured or centralised.

Preferably, first and second end bands are arranged around the tubular member at the end sections. More preferably, the bands are of a metal which does not yield to morphing. Alternatively, the bands are of the same material as the tubular member with an increased thickness compared to the tubular member so that they do not yield to morphing. In this way, a defined section of the tubular, being the central section, can be morphed.

Preferably, the first and second end sections have a first outer diameter and the central section has a second outer diameter, over a majority of its length, being greater than the first outer diameter, the tubular member being tapered between the central section and the end sections providing first and second inclined surfaces and the first and second end bands are arranged around the tubular member at the end sections in spaced apart relationship to the first and second inclined surfaces. In this way, a majority of the first and second end portions are prevented from morphing while the first and second inclined surfaces are free to be uniformly morphed. Additionally, without a slip on these outermost inclined surfaces, morphing is achieved over the whole central section.

Preferably, the tubular member has a wall thickness adapted to morph uniformly along its length. In an embodiment, the tubular member has a uniform wall thickness. In this way, morphing will be uniform.

Preferably, a gasket is arranged around the central section. More preferably the gasket is arranged equidistantly from the first and second inclined surfaces. In this way, hydraulic lock is prevented when the packer is set in another tubular member. Preferably the gasket comprises a rectangular groove arranged circumferentially around the outer surface of the central section with an annular rubber seal located in the groove. Advantageously the wall thickness of the tubular member and a width of the groove are selected to achieve a seal by contact of the rubber seal to the outer cylindrical structure with some compression of the rubber seal. The rubber seal is therefore not crushed, but is compressed or squeezed. In this way, the profile of the groove remains during morphing so that the seal and groove act as a gasket to prevent a possible leak path between the packer and the outer cylindrical structure.

Preferably, there is a plurality of anchoring arrangements on the central section. More preferably, the anchoring arrangements are arranged in pairs symmetrically along the central section. There may be two anchoring arrangements on the central section. More preferably, there are four anchoring arrangements on the central section. In this arrangement, two anchoring arrangements may be located adjacent each other towards each end of the central section. Alternatively, there are ten anchoring arrangements on the central section. In this way, the number of anchoring arrangements can be selected to ensure successful grip of the packer is achieved.

According to a second aspect of the present invention there is provided a method of setting morphable packer, comprising the steps:

(a) locating a morphable packer according to the first aspect on a tubular string;
(b) running the tubular string into a wellbore and positioning the morphable packer at a desired location within a larger diameter cylindrical structure;
(c) pumping fluid through the tubular string to cause the central portion of the tubular member to move radially outwardly and morph against an inner surface of the larger diameter structure; and
(d) using the morphing tubular member to move oppositely arranged abutting slips formed from the gripping elements in the anchoring arrangement radially outwardly by the morphing action to engage the larger diameter structure.

In this way, the morphed tubular creates a packer within a wellbore and the slips act against each other to prevent longitudinal movement of each slip during radial expansion.

The larger diameter structure may be an open hole borehole, a borehole lined with a casing or liner string which may be cemented in place downhole, or may be a pipeline within which another smaller diameter tubular section requires to be secured or centralised.

The method may include the steps of running in a hydraulic fluid delivery tool, creating a temporary seal at the end sections to isolate a space and injecting fluid from the tool into the space to morph the tubular member. Preferably, the seal is at the end bands.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 2:
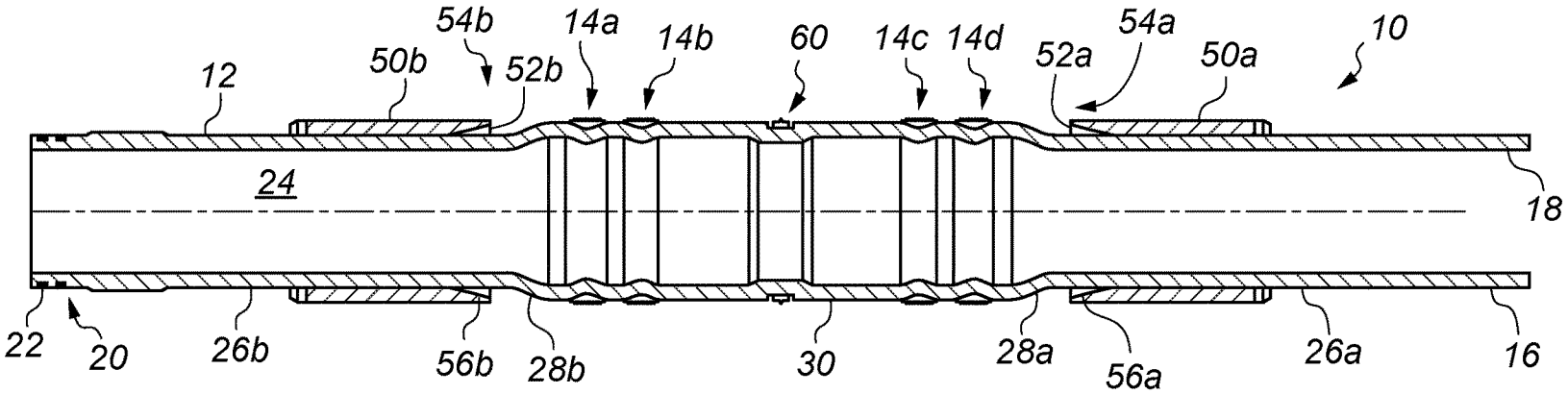
FIG. 2 is a cross-sectional view through a morphable packer according to an embodiment of the present invention.
Figure 4:
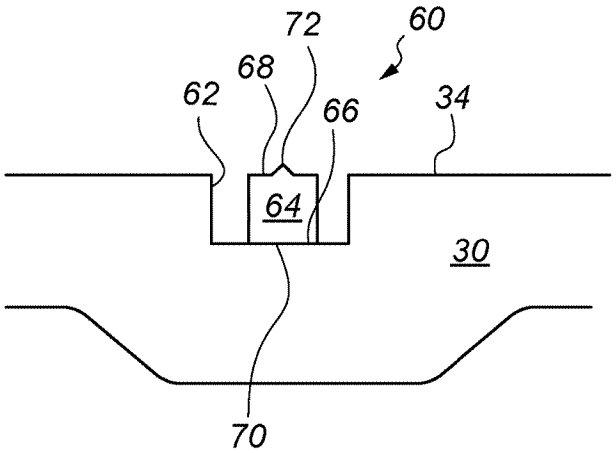
Figure 3A:
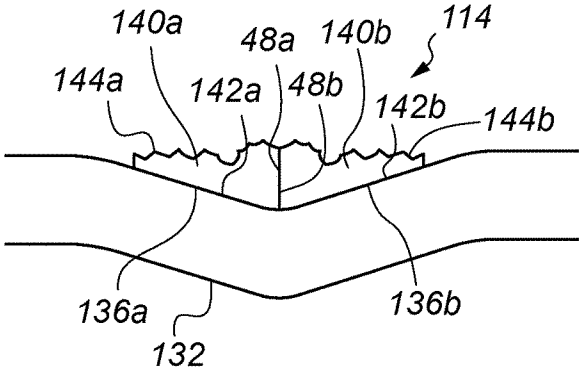
Figure 3B:
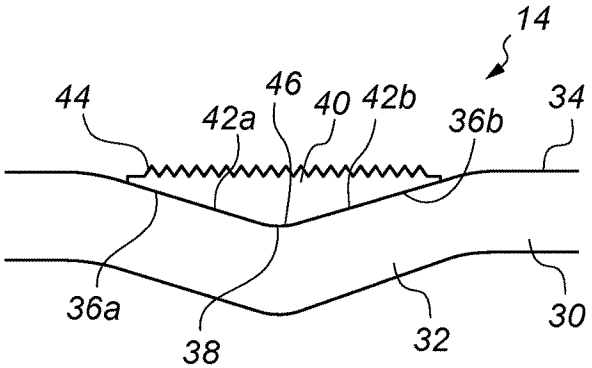
Figure 5:
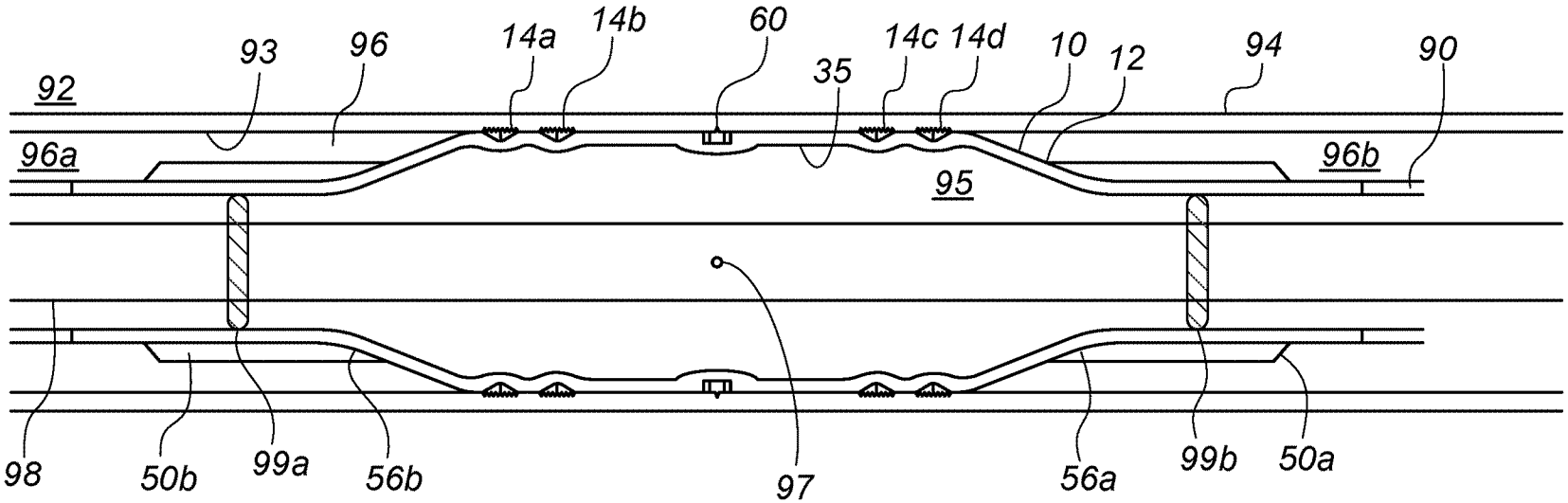

FIGS. 3(*a*) and 3(*b*) are cross-sectional views of embodiments of anchoring arrangements for use on a morphable packer according to the present invention;

FIG. 4 is a cross-sectional view of the sealing arrangement of the morphpacker of FIG. 2; and FIG. 5 is a cross-sectional view through the morphable packer of FIG. 2 when set according to an embodiment of the present invention.

Reference is initially made to FIG. 2 of the drawings which illustrates a morphable packer, generally indicated by reference numeral 10, including a tubular member 12 and anchoring arrangements 14*a,b,c,d* according to an embodiment of the present invention.

Tubular member 12 is a cylindrical tubular pipe providing a tubular body having at a lower end 16, a box section 18 and at an upper end 20, a pin section 22 for connecting the member 12 into a tubing string as is known in the art. The tubing string may be casing, liner or production tubing that is intended to be permanently set or completed in a well bore. Member 12 includes a throughbore 24 which is colinear with the throughbore of the string.

Tubular member 12 is a steel cylinder formed of typically 4140 or 4130 grade steel but could be any other suitable grade of steel or any other metal material or any other suitable material which undergoes elastic and plastic deformation when morphed. The tubular member 12 has a substantially uniform thickness along its length. The tubular member 12 has a non-uniform outer diameter. From the lower end 16, a first end section 26*a* of the tubular member 12 has a first outer diameter. This first end section 26*a* is then tapered outwardly to a central section 30 providing a first inclined surface 28*a* therebetween. The central section 30 has a substantially uniform outer diameter, being a second outer diameter greater than the first outer diameter. Towards the upper end 20, the member is tapered again to reduce the outer diameter to the first outer diameter along a second end section 26*b*. At this taper a second inclined outer surface 28*b* is then provided, being the reverse and a mirror image of the first inclined outer surface 28*a*. In this way, the packer 10 is symmetrical between the ends 16,22.

Located on and around the central portion 30 are anchoring arrangements 14*a-d*. The anchoring arrangement 14*a-d* are preferably identical, but may vary in dimensions if desired. A cross-sectional view through a part of an anchoring arrangement is shown in FIGS. 3(*a*) and (*b*). Referring to FIG. 3(*a*) there is illustrated the central portion 30 now having a recess 32 arranged circumferentially around the tubular member 12. Like parts to those of FIG. 2 have been given the same reference numeral to aid clarity. Recess 32 may be considered as a v-groove, but the wall thickness at the recess substantially matches the wall thickness of the tubular member 12 over the packer 10. In this way, recess 32 may be considered as an undulation in the wall of the central portion 30. The tubular member 12 wall thickness may be thinned over the recess 32 to ensure uniform morphing. On the outer surface 34 of the central section 30, the recess 32 provides opposing angled surfaces 36*a,b*. The surfaces are symmetrical and rise from a central base 38 to the outer surface 34.

Located within the recess 32 is a gripping element 40. Gripping element 40 is formed as an annular ring which is substantially triangular in cross-section and made of a hardened material which does not elastically deform under the pressures being used to morph the packer 10. Element 40 has two adjacent inclined surfaces 42*a,b* whose dimensions match those of the angled surfaces 36*a,b* of the recess 32, with an apex 46 at the base 38 providing an inner diameter to the annular ring. The outwardly facing surface 44 of the element 40 is toothed or spiked, to providing a gripping surface 48 which bites into and grips to anchor into any outer tubular structure which the packer 10 is set within. The gripping surface may be formed by machining circumferential grooves around the ring. It should be noted however that these grooves are entirely circumferential and not formed as a single helical groove. In this way, no potential leak path can exit along the gripping surface 48.

The gripping element 40 is made up of six arc segments or slips. This simplifies construction with the segments being held in the recess 32 by C-rings, snap rings or wire as is known in the art. Alternatively, a c-ring cage may be used. The segmented arrangement also allows for expansion of the ring when the central section is morphed radially outwardly.

Figure 1:
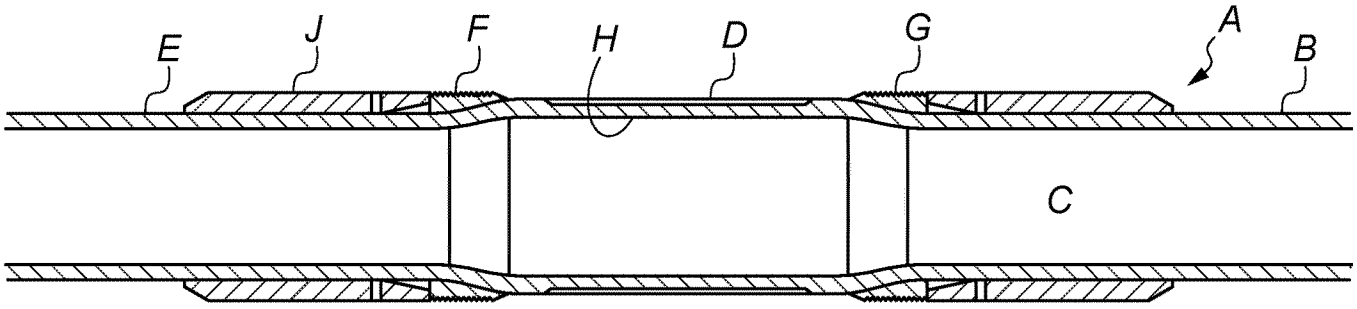
PRIOR ART Figure 1
FIG. 1 is a cross-sectional view through a morphable packer according to the prior art.

An alternative and preferred embodiment of an anchoring arrangement, generally referred to as 114, is shown in FIG. 3(*b*). Like parts to those of FIG. 3(*a*) have been given the same reference numeral with the addition of 100. In the embodiment of FIG. 3(*b*), recess 132 is identical to recess 32, with inclined surfaces 136*a,b* matching inclined surfaces 36*a,b*. The striking difference is in the fact that the gripping element 40 now comprises two parts 140*a,b*. Each part 140*a,b* can now be likened to the slips of the prior art packer in FIG. 1. Each slip 140*a,b* remains triangular in cross-section but is formed with a side wall 48*a,b* which is perpendicular to the outer toothed surface 144*a,b* and a single inclined surface 142*a,b* which matches the inclined surface 136*a,b* of the recess 132 to which it is arranged against. It will be seen that each slip 140*a,b* resembles a wedge, but in the present invention two slips 144*a,b* are oppositely arranged with their side walls 48*a,b* abutting. By having two slips 140*a,b* they each advantageously use the side wall 48*a,b* of the opposing slip 140*b,a* to prevent longitudinal movement of the slip 140*a,b* when the packer 10 is being morphed or radially expanded.

Like the anchoring arrangement 14, the slips 140*a* and 140*b* are each formed as annular rings made up of arc segments, preferably six, but two, three or four, may be used. The segments are held in place by C-rings, snap rings or wire as is known in the art. Alternatively, a c-ring cage may be used. The segments of the slips 140*a* and 140*b* are arranged to be out of alignment so that, following expansion, the segments, together provide full circumferential coverage around the tubular member 12.

There may be a single anchoring arrangement 14 on the packer 10. Alternatively a plurality of anchoring arrangements is arranged on the packer 10. In a preferred embodiment, the anchoring arrangements are provided as adjacent pairs providing a concertina effect on the tubular member by adjacent recesses, see FIG. 2. In a preferred embodiment, two pairs of anchoring arrangements are arranged symmetrically and spaced equidistantly from a centre point of the central section.

Returning to FIG. 2, a further feature of the packer 10 is the use of end bands 50*a,b*. End bands 50*a,b* are used for the same purpose as the end bands 3 in FIG. 1. The end bands 50*a,b* are arranged on each end section 26*a,b*. Each end band 34*a,b* is a cylindrical steel sleeve which fits over the tubular member 12 and is affixed thereto. The end bands 50*a,b* are formed of a higher gauge steel than the tubular member 12, the gauge being sufficient to be unaffected by morphing. Thus the end bands 50*a,b* are static and prevent the end portions 50*a,b* at the end bands 50*a,b* from being able to move during morphing. A portion 52*a,b* at a first end 54*a,b* of each end band 50*a,b* may also tapered to provide a further inclined surface 56*a,b*. However, unlike the end bands 3 of the prior art packer A, the end bands 50*a,b* are located a distance away from the inclined surfaces 28*a,b* providing an exposed portion of the outer surface of the end section 26*a,b* between the end inclined surfaces 28*a,b* and the ends 54*a,b* of the end bands 50*a,b* respectively.

Also shown on the packer of FIG. 2 is a sealing arrangement, generally indicated by reference numeral 60, and shown in an exploded view in FIG. 4. Sealing arrangement 60 comprises a groove 62 which is rectangular in cross-section and runs circumferentially around the outer surface 43 of the central section 30. It is noted that the wall thickness of the tubular member 12 at the central section 30 around the groove 62 remains approximately the same so that, when morphed, the groove 62 will be moved radially outwards with little change in its dimensions. Sitting within the groove 62 is a sealing element 64. Sealing element 64 is an elastomeric annular ring or other sealing ring which seals on compression. Sealing element 64 has a substantially square cross-section providing an inner face 66 and an outer face 68. Each face 66,68 will be a part cylindrical section. The inner face 66 is arranged to sit tightly against the base 70 of the groove 62. The inner face 66 may be bonded to the base 70. On the outer face 68 there is arranged a ridge 72. Ridge 72 is part of the sealing element 64 and provides a circumferential sealing line around the packer 10. It is noted that the sealing element 64 has a width which is less than the width of the groove 62. The space around the sealing element 64 is provided so that the sealing arrangement 60 acts as a gasket during morphing. That means that the sealing element 64 is not crushed by the tubular member 12 and is merely brought into contact with the outer tubular or borehole wall with some compression or squeezing to provide a sufficient seal.

Packer 10 is assembled by arranging the sealing element 64 in the groove 62 and placing pairs of oppositely arranged or reversed slips 140*a,b* into the recesses 132. The end bands 50*a,b* are slid over the upper 20 and lower 16 ends of the tubular member 12 respectively and pinned to the tubular member 12 at a distance from the tapered surfaces 28*a,b*. In the embodiment shown in FIG. 2 there are four recesses arranged as two pairs at either end of the central section. However, it will be realised that a single recess or any number of recesses can be arranged along the central section. The recesses can be located in pairs to provide two pairs of adjacent reversed slips. Any combination of recesses is arranged symmetrically around a central point on the packer 10.

Reference will now be made to FIG. 5 of the drawings which provides an illustration of the morphable packer 10 once set and is used to describe a method for setting a morphable barrier within a well bore according to an embodiment of the present invention. Like parts to those in the earlier Figures have been given the same reference numerals to aid clarity.

In use, the packer 10 is conveyed into the borehole by any suitable means, such as incorporating the packer 10 into a casing or liner string 90 and running the string 90 into a wellbore 92 until it reaches the location within a casing 94 at which operation of the packer 10 is intended. This location is normally within the borehole at a position where the packer 10 is required in order to, for example, isolate the annulus 96 between the string containing the tubular member 12 and an outer casing 94, into an annular zone 96*a* located above the packer 10 from that below 96*b*.

A hydraulic fluid delivery tool 98 is used to set the morphed packer. The tool 98 can be run with the packer 10, by locating seals 99*a,b* of the tool against the inner surface 35 of the tubular member 12 at the location of the end bands 50*a,b*. Alternatively, once the string 90 reaches its intended location, tool 98 can be run into the string 90 from surface by means of a coiled tubing or other suitable method. The seals 99*a,b* can then be set against the inner surface 35 of the tubular member 12. With the seals 99*a,b* set an enclosed annular chamber 95 is formed between the tool 98 and the inner surface 35 of the packer 10 at the central section 30. A port 97 in the tool 98 can then be opened to allow pressurised fluid to enter the chamber 95. As the chamber 95 is sealed and of fixed volume, the consequent increase in pressure of fluid in chamber 95 causes the fluid to act directly against the inner surface 35 of the tubular member 12 between the seals 99*a,b*. The direct radially applied hydraulic pressure upon the inner surface 35 causes the tubular member 12 to move radially outwards under elastic expansion. The end bands 50*a,b*, prevent expansion as they do not yield to the pressure, but the tubular member 12 at the ends 52*a,b* of the end bands 50*a,b* will move outwards to contact the inclined surfaces 56*a,b*. This expansion against a tapered surface prevents fracture or weakness points which would occur if the bands 50*a,b* had end faces which were perpendicular to the outer surface 34 of the tubular member 12.

The central most point of the tubular member 12 will contact the inner surface 93 of the casing 94 first. This is the ridge 72 of the seal 64. Contact operates the gasket sealing arrangement 60 and prevents hydraulic lock across the packer as contact between the packer 10 and the casing 94 will now spread from the centre at the ridge 72 to the ends 16,20. Fluid within the annulus 96 is thus driven out from above and below as the packer 10 is set when central section 30 is morphed against the inner surface 93 of the casing 94 and seals against a portion of the inner surface 93 of the casing 94. It will be appreciated that prevention of hydraulic lock could also be achieved by arranging at least one pair of seals 64 on the central section 30 away from the central most point and thinning the thickness of the tubular member 12 at the central most point so that the central most point will preferentially morph first and create the initial contact with the casing 94.

In the embodiment shown, as the tubular member has walls of uniform thickness or substantially uniform thickness, any differences being applied to tune the thickness of the wall and ensure uniform expansion during morphing, the expansion of the central section 30 will uniformly push the anchoring arrangements 14*a-d* radially outwardly towards the casing 94. At each recess 32 morphing will tend to drive the inclined edges 36*a,b* towards each other to act like oppositely arranged wedges under the gripping element 40. For the single piece gripping element 40, this will cause pinching which forces the gripping element 40 against the inner surface 93 of the casing 94 to engage therewith. For the reversed slip arrangement of FIG. 3(*b*), the wedge effect will merely drive the slips 140*a,b* longitudinally against each other as morphing of the occurs and the slips 140*a,b* will be uniformly pushed radially outwards by pressure in the chamber 95. The toothed surfaces 144*a,b* will bite into the inner surface 93 of the casing 94 and anchor the packer 10 to the casing 94.

The pressure on the tubular member 12 between the seals 99*a,b* continues to increase such that the tubular member 12 initially experiences elastic expansion followed by plastic deformation. The central section 30 expands radially outwardly beyond its yield point, undergoing plastic deformation until the tubular member 12 morphs against the surface 93 of the casing 94 as shown in FIG. 5. The casing 94 will also undergo elastic deformation and expand by a small amount. When the pressure is bled off the casing will relax and return to it's original diameter and enhance the seal between the packer 10 and the casing 94. When the pressurised fluid is bled off, the seals 99*a,b* are deactivated and the tool 98 pulled out of the wellbore. Accordingly, the tubular member 12 has been plastically deformed and morphed by fluid pressure without any mechanical expansion means being required and the gripping elements have been activated by morphing without requiring being axial (mechanical) or hydraulic set.

The principle advantage of the present invention is that it provides a morphable packer in which pairs of reversed slips are activated by morphing.

A further advantage of the present invention is that it provides a method for setting a permanent packer which is entirely activated by morphing.

It will be apparent to those skilled in the art that modifications may be made to the invention herein described without departing from the scope thereof. For example, were two gripping elements are arranged in a recess the gripping elements may be keyed together to prevent independent radial movement of either element. The central section and the inclined surfaces may be thinner walled than the remainder of the tubular member to make morphing easier and provide ends with standard dimensions of pipe, liner or casing for connection in the string.

We claim:

1. A morphable packer comprising:

a tubular member being a tubular body having first and second end sections and a central section therebetween, and a throughbore, the tubular member arranged to be run in and secured within a larger diameter generally cylindrical structure via morphing of the tubular body by fluid pressure acting against an inner surface of the tubular body causing the central section to expand and create a seal between the central section and the cylindrical structure;

the central section includes an anchoring arrangement, the anchoring arrangement comprising: a recess in the tubular body located circumferentially around an outer surface of the central section, the recess having opposing side walls which are each tapered from a bottom of the recess to the outer surface; and two gripping elements each gripping element being triangular in cross-section, comprising an outward facing surface adapted to grip, an inclined edge and an adjoining surface with the two gripping elements being within the recess and the adjoining surfaces contacting each other; wherein the two gripping elements are initially located within the recess and the inclined edges each abuts one of the side walls of the recess; and upon morphing of the tubular member to create the seal between the central section and the cylindrical structure, the two gripping elements are moved radially outwards by the morphing action on the tubular to engage, grip and anchor into the cylindrical structure.

2. A morphable packer according to claim 1 wherein the gripping elements comprises one or more sections, the one or more sections being arranged circumferentially around the expandable portion and having an outer surface including at least a portion adapted to grip.

3. A morphable packer according to claim 2 wherein the gripping elements comprises one section being a substantially annular member.

4. A morphable packer according to claim 1 wherein the outward facing surface comprises a plurality of circumferential ridges, the ridges providing a spike or tooth tip for gripping.

5. A morphable packer according to claim 1 wherein the large diameter structure is selected from a group comprising: an open hole borehole, a borehole lined with a casing or liner string which may be cemented in place downhole, or a pipeline within which another smaller diameter tubular section requires to be secured or centralised.

6. A morphable packer according to claim 1 wherein first and second end bands are arranged around the tubular member at the end sections, the bands preventing the tubular member from morphing at their location.

7. A morphable packer according to claim 6 wherein the first and second end sections have a first outer diameter and the central section has a second outer diameter, over a majority of its length, being greater than the first outer diameter, the tubular member being tapered between the central section and the end sections providing first and second inclined surfaces and the first and second end bands are arranged around the tubular member at the end sections in spaced apart relationship to the first and second inclined surfaces.

8. A morphable packer according to claim 1 wherein the tubular member has a uniform wall thickness along its length.

9. A morphable packer according to claim 1 wherein at least one gasket is arranged around the central section.

10. A morphable packer according to claim 9 wherein one gasket is arranged equidistantly from the first and second inclined surfaces.

11. A morphable packer according to claim 9 wherein the gasket comprises a rectangular groove arranged circumferentially around the outer surface of the central section with an annular rubber seal located in the groove.

12. A morphable packer according to any claim 1 wherein there is a plurality of anchoring arrangements on the central section.

13. A morphable packer according to claim 12 wherein the anchoring arrangements are arranged in pairs symmetrically along the central section.

14. A morphable packer according to claim 13 wherein two pairs of anchoring arrangements are arranged on the central section.

15. A morphable packer according to claim 12 wherein there are four anchoring arrangements on the central section.

16. A morphable packer according to claim 15 wherein two anchoring arrangements are located adjacent each other towards each end of the central section.

17. A method of setting morphable packer, comprising the steps:

(a) locating a morphable packer in a string, the morphable, packer comprising a tubular member having a throughbore, the tubular member arranged to be run in and secured within a larger diameter generally cylindrical structure; the tubular member having first and second end sections and a central section therebetween; the central section including an anchoring arrangement, the anchoring arrangement comprising: a recess in the tubular body located circumferentially around an outer surface of the central section, the recess having opposing side walls which are each tapered from a bottom of the recess to the outer surface; and two gripping elements, each gripping element being substantially triangular in cross-section, comprising an outward facing surface adapted to grip, an inclined edge and an adjoining surface with the adjoining surfaces of each gripping element contacting each other; wherein the gripping elements are initially located within the recess and the inclined edges abuts one of the side walls of the recess;

(b) running the tubular string into a wellbore and positioning the morphable packer at a desired location within a larger diameter cylindrical structure;

(c) pumping fluid through the tubular string to cause the central portion of the tubular member to move radially outwardly and morph against an inner surface of the larger diameter structure; and (d) using the morphing tubular member to move oppositely arranged abutting slips formed from the gripping elements in the anchoring arrangement radially outwardly by the morphing action to engage, grip and anchor to the larger diameter structure.

* * * * *